US010246995B2

(12) United States Patent
Huber et al.

(10) Patent No.: US 10,246,995 B2
(45) Date of Patent: Apr. 2, 2019

(54) FLOW RESTRICTION DEVICE WITH VARIABLE SPACE FOR USE IN WELLBORES

(71) Applicants: Cord Simon Huber, Gehrden (DE); Volker Peters, Wienhausen (DE); Heiko Eggers, Bad Fallingbostel (DE)

(72) Inventors: Cord Simon Huber, Gehrden (DE); Volker Peters, Wienhausen (DE); Heiko Eggers, Bad Fallingbostel (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/389,019

(22) Filed: Dec. 22, 2016

(65) Prior Publication Data

US 2018/0179890 A1 Jun. 28, 2018

(51) Int. Cl.
*E21B 47/18* (2012.01)
*E21B 34/08* (2006.01)

(52) U.S. Cl.
CPC ..... *E21B 47/187* (2013.01); *E21B 34/08* (2013.01)

(58) Field of Classification Search
None
See application file for complete search history.

(56) References Cited

U.S. PATENT DOCUMENTS

| | | | | |
|---|---|---|---|---|
| 3,764,968 | A * | 10/1973 | Anderson | E21B 47/18 367/84 |
| RE29,734 | E | 8/1978 | Manning | |
| 4,785,300 | A | 11/1988 | Chin et al. | |
| 5,787,052 | A | 7/1998 | Gardner et al. | |
| 7,330,397 | B2 | 2/2008 | Ganesan et al. | |
| 9,000,939 | B2 * | 4/2015 | Sitka | E21B 47/06 340/853.3 |
| 2013/0250728 | A1 * | 9/2013 | Burgess | E21B 47/187 367/84 |

FOREIGN PATENT DOCUMENTS

EP 2957717 A1 12/2015

* cited by examiner

*Primary Examiner* — Muhammad N Edun
*Assistant Examiner* — Jerold Murphy
(74) *Attorney, Agent, or Firm* — Cantor Colburn LLP

(57) ABSTRACT

An apparatus for use in a wellbore is disclosed that in one non-limiting embodiment includes a flow restriction device that that contains a channeling element having a fluid flow passage, a restriction element spaced from the channeling element defining a gap between the restriction element and the channeling element, wherein relative movement between the restriction element and the channeling element obstructs flow of a fluid flowing through the flow passage to increase pressure in the fluid across the device. In one embodiment an activation device displaces one of the channeling element and the restriction element to adjusts or alter gap in response to certain changes in the pressure across the restriction device.

20 Claims, 5 Drawing Sheets

FLOW RESTRICTION DEVICE WITH VARIABLE SPACE FOR USE IN WELLBORES

BACKGROUND

1. Field of the Disclosure

The disclosure relates generally to a flow restriction device that includes a variable space or gap between a flow channeling element or member and a restriction element or member, generally for use in wellbore applications, including generating pressure pulses in a fluid in the wellbore.

2. Background Art

Wells or wellbores are formed for the production of hydrocarbons (oil and gas) from subsurface formation zones where such hydrocarbons are trapped. To drill a wellbore, a drill string is conveyed into the wellbore. The drill string includes a drilling assembly, commonly referred to as a "bottomhole assembly" or "BHA," attached to the bottom of a tubular (drill pipe or a coiled tubing). A drill bit is attached to the bottom of the drilling assembly. To drill the wellbore, a drilling fluid (commonly referred to as the "mud") is supplied under pressure to the drill string at the surface, which fluid passes through the drilling assembly and discharges at the bottom of the drill bit. The drill bit is rotated by rotating the drill string at the surface and/or by a mud motor in the drilling assembly. The drill bit disintegrates the formation rock into pieces, referred to as the cuttings. The drilling fluid discharged at the drill bit bottom flows to the surface via space between the drill sting and the wellbore, referred to as the annulus, carrying the cuttings therewith. The mud motor rotates due to the flow of the drilling fluid through the mud motor in the drilling assembly. The drilling assembly includes a number of tools, referred to as logging-while-drilling tools, including a resistivity tool, acoustic tool, nuclear tool, etc. for providing measurement relating to characteristics of the formation surrounding the drilling assembly. The drilling assembly also includes a variety of other sensors (referred to as measurement—while—drilling sensors) that provide measurements relating to various parameters of the drill string and drilling operations. The drilling assembly also includes one or more controllers and memory devices. These tools and sensors generate copious amounts of data, which is processed by the controllers and stored in the memory devices in the drilling assembly. A generator in the drilling assembly, operated by the drilling fluid flowing the drilling assembly, generates electrical energy for use by the various tools sensors and other devices and circuits in the drilling assembly.

The data from the various tools and sensors in the drilling assembly is transmitted to a surface controller using a telemetry system. One such telemetry system transmits signals in the form of pressure pulses generated downhole. A pulse generator in the drilling assembly, referred to herein as the "pulser", is commonly used to generate the pressure pulses in the drilling fluid flowing through the drilling assembly. One type of pulser includes a stator and a rotor with a relatively small spacing or gap between the rotor and the stator. The stator includes one or more fluid flow passages or openings, which allow free flow of the drilling fluid through the stator. The rotor also includes one or more passages or openings. In the idle position, the rotor passages align with the stator passages, which allows free flow of the drilling fluid through the pulser. When the rotor oscillates or rotates, it obstructs the flow of the fluid through stator passages, which produces a pressure pulse in the fluid flowing through the drilling assembly. The drilling fluid often includes debris that can clog the gap between the rotor and the stator, thereby blocking the flow of the fluid through the pulser or jamming the rotor and rendering the pulser inoperable. In such a case, the pulser is unable to produce the pressure pulses with desired characteristics or in some cases unable to produce any pressure pulses. To continue drilling operations, the drill string is tripped out of the wellbore to fix or replace the pulser, which is time consuming, expensive and shuts down the drilling operations for extended time periods.

The disclosure herein provides a flow restriction or control device that may be utilized as a pulser downhole that addresses the above-noted problems and may also be adapted for use as a bypass valve, booster valve, packer valve, sampling valve, etc.

SUMMARY

In one aspect, an apparatus for use in a wellbore is disclosed that in one non-limiting embodiment includes a flow restriction device that that contains a channeling element having a fluid flow passage, a restriction element spaced from the channeling element defining a gap between the restriction element and the channeling element, wherein relative movement between the restriction element and the channeling element obstructs flow of a fluid flowing through the flow passage to increase pressure in the fluid across the device. In one embodiment an activation device displaces one of the channeling elements and the restriction element to adjust or alter gap in response to certain changes in the pressure across the restriction device.

In another aspect, a method of utilizing a flow restriction device in a wellbore is disclosed that in one non-limiting embodiment includes: conveying an assembly in the wellbore that includes the flow restriction device that contains a channeling element having a flow passage and a restriction element spaced from the channeling element defining a gap between the restriction element and the channeling element, wherein relative movement between the restriction element and the channeling element obstructs flow of a fluid flowing through the flow passage to increase pressure in the fluid, and an activation device that adjusts the gap by displacing or moving at least one of the channeling element and the restriction element in response to changes in the pressure across a restriction device; flowing a fluid through the assembly and the restriction device; operating the restriction device to obstruct flow of the fluid through the restriction device to generate pressure pulses in the fluid flowing through the assembly; and increasing the gap when the pressure across the restriction device or a section thereof is greater than a first threshold and decreasing the gap when such pressure is less than a second threshold, wherein the second threshold is less than the first threshold.

Examples of certain features of an apparatus and methods have been summarized rather broadly in order that the detailed description thereof that follows may be better understood, and in order that the contributions to the art may be appreciated. There are, of course, additional features that will be described herein after and which will form the subject of the claims.

DRAWINGS

For a detailed understanding of the apparatus and methods disclosed herein, reference should be made to the accompanying drawings and the detailed description thereof, wherein like elements are generally given same numerals and wherein.

DETAILED DESCRIPTION

Figure 1:
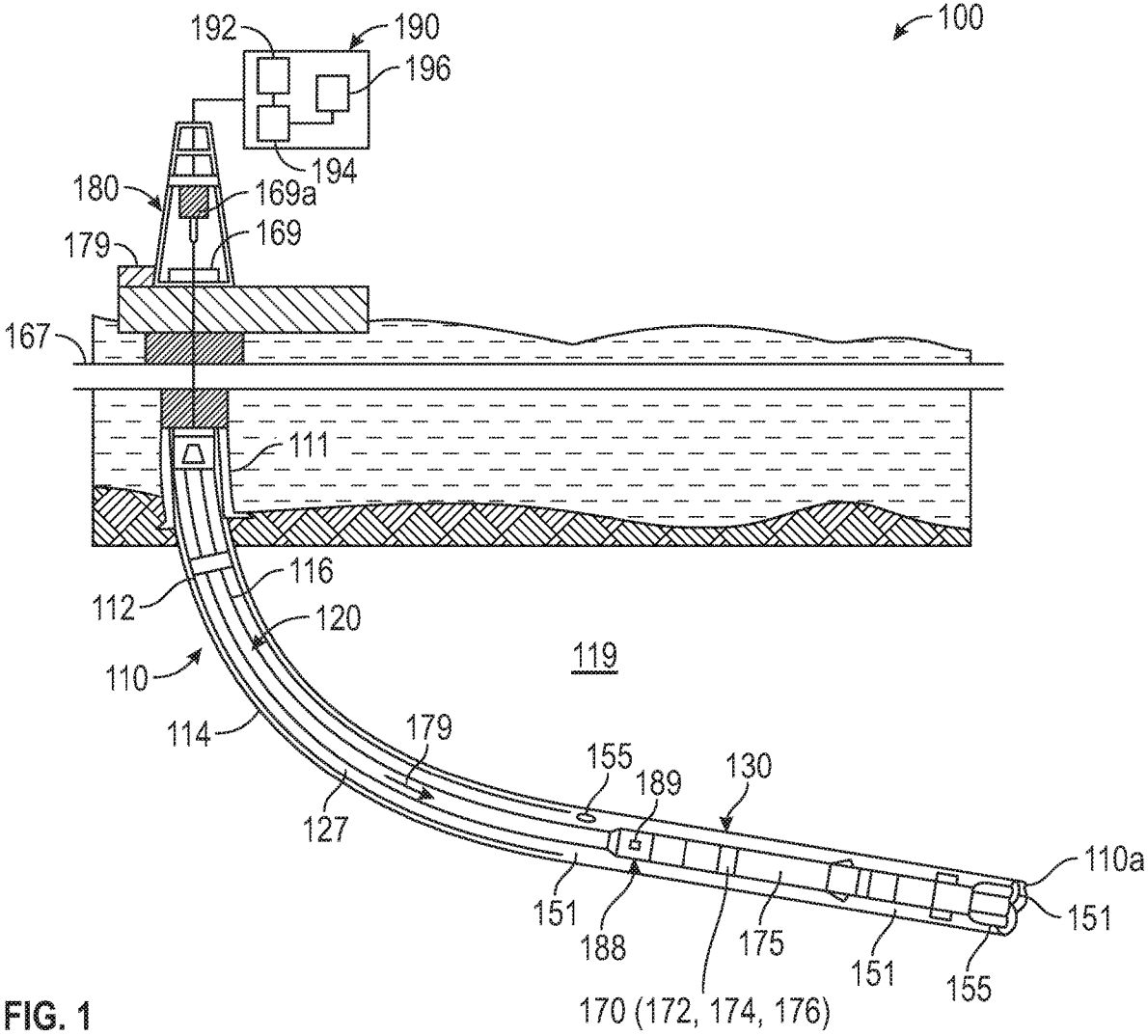
FIG. 1 shows a schematic diagram of an exemplary drilling system that includes a drilling assembly having a pulse generator that produces pressure pulses according to one non-limiting embodiment of the disclosure.

FIG. 1 is a schematic diagram of an exemplary drilling system 100 for drilling wellbores that includes a telemetry system made according to one embodiment of the disclosure. The drilling system 100 is shown to include a wellbore 110 (also referred to as a "borehole" or "well") being formed in a formation 119 that includes an upper wellbore section 111 with a casing 112 installed therein and a lower wellbore section 114 being drilled with a drill string 120. The drill string 120 includes a tubular member 116 (drill pipe or coiled tubing) that has attached to its bottom end a drilling assembly 130 (also referred to as the "bottomhole assembly" or "BHA"). The drilling assembly 130 that includes a drill bit 155 attached to its bottom end. The drill string 120 is shown conveyed into the wellbore 110 from an exemplary rig 180 at the surface 167. The exemplary rig 180 in FIG. 1 is shown as a land rig for ease of explanation. The apparatus and methods disclosed herein may also be utilized with offshore rigs. A rotary table 169 or a top drive 169*a* coupled to the drill string 120 may be utilized to rotate the drill string 120 and the drilling assembly 130. A control unit (also referred to as a "controller" or "surface controller") 190 at the surface 167, which may be a computer-based system, may be utilized for receiving and processing data related to various downhole measurements transmitted by a telemetry system, such as a mud pulse telemetry system described later and to control various tools and sensors in the drilling assembly 130. The surface controller 190 may include a processor 192, a data storage device (or a computer-readable medium) 194 for storing data and computer programs 196 accessible to the processor 192 for determining various parameters of interest during drilling of the wellbore 110 and for controlling selected operations of the various tools in the drilling assembly 130 and those of drilling of the wellbore 110. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116, which fluid passes through the drilling assembly 130 and discharges at the bottom 110*a* of the drill bit 155. The drill bit 155 disintegrates the formation rock into cuttings 151. The drilling fluid 179 returns to the surface 167 along with the cuttings 151 via the annular space (also referred as the "annulus") 127 between the drill string 120 and the wellbore 110.

Still referring to FIG. 1, the drilling assembly 130 may further include one or more downhole sensors (also referred to as the measurement-while-drilling (MWD) sensors and logging-while-drilling (LWD) sensors or tools, collectively referred to as downhole devices and designated by numeral 175, and at least one control unit or controller 170 for processing data received from the devices 175. The downhole devices 175 may include sensors for providing measurements relating to various drilling parameters, including, but not limited to, vibration, whirl, stick-slip, flow rate, pressure, temperature, and weight-on-bit. The drilling assembly 130 further may include tools for determining various characteristics of the formation 119. Such tools include, but are not limited to, a resistivity tool, an acoustic tool, a gamma ray tool, a nuclear tool, a nuclear magnetic resonance tool, and a formation on testing tool. Such devices are known in the art and are thus not described herein in detail. The drilling assembly 130 also includes a power generation device 186 and a suitable mud pulse telemetry unit 188. The drilling assembly 130 further includes a controller 170 that may include a processor 172, such as a microprocessor, a data storage device 174 and a program 176 accessible to the processor 172. The controller 170 communicates with the controller 190 to control various functions and operations of the various tools and devices in the drilling assembly 130, including the operation of the telemetry unit 188. The telemetry unit 188 includes a flow restriction device, such as pulser 189 that selectively restricts the flow of the drilling fluid 179 flowing through the drilling assembly 130 to generate pressure pulses in the drilling fluid 179. In one embodiment, the pulser 189 may be a rotating pulser or oscillating pulser in which a member partially or fully rotates to obstruct flow of the drilling fluid 179 through a stationary member to produce pressure pulses. In another embodiment, both members may move relative to each other to obstruct the flow of the fluid. In such pulsers, gap or spacing between the rotating member (referred to as the rotor) and the stationary member (referred to as the stator) is relatively small and is subject to jamming due to the presence of solid particles (also referred to herein as debris) in the drilling fluid. Although the pulser described herein produces pulses when a member rotates (i.e. oscillates or fully rotates), the mechanisms to dislodge the jamming described herein are also applicable to other flow control devices prone to jamming, including, but not limited to, a bypass valve, booster valve, packer valve, and sampling valve. Such devices are known in the art and thus not described herein in detail. An exemplary pulser according to one non-limiting embodiment of the disclosure is described in more detail in reference to FIGS. 2-7.

Figure 2:
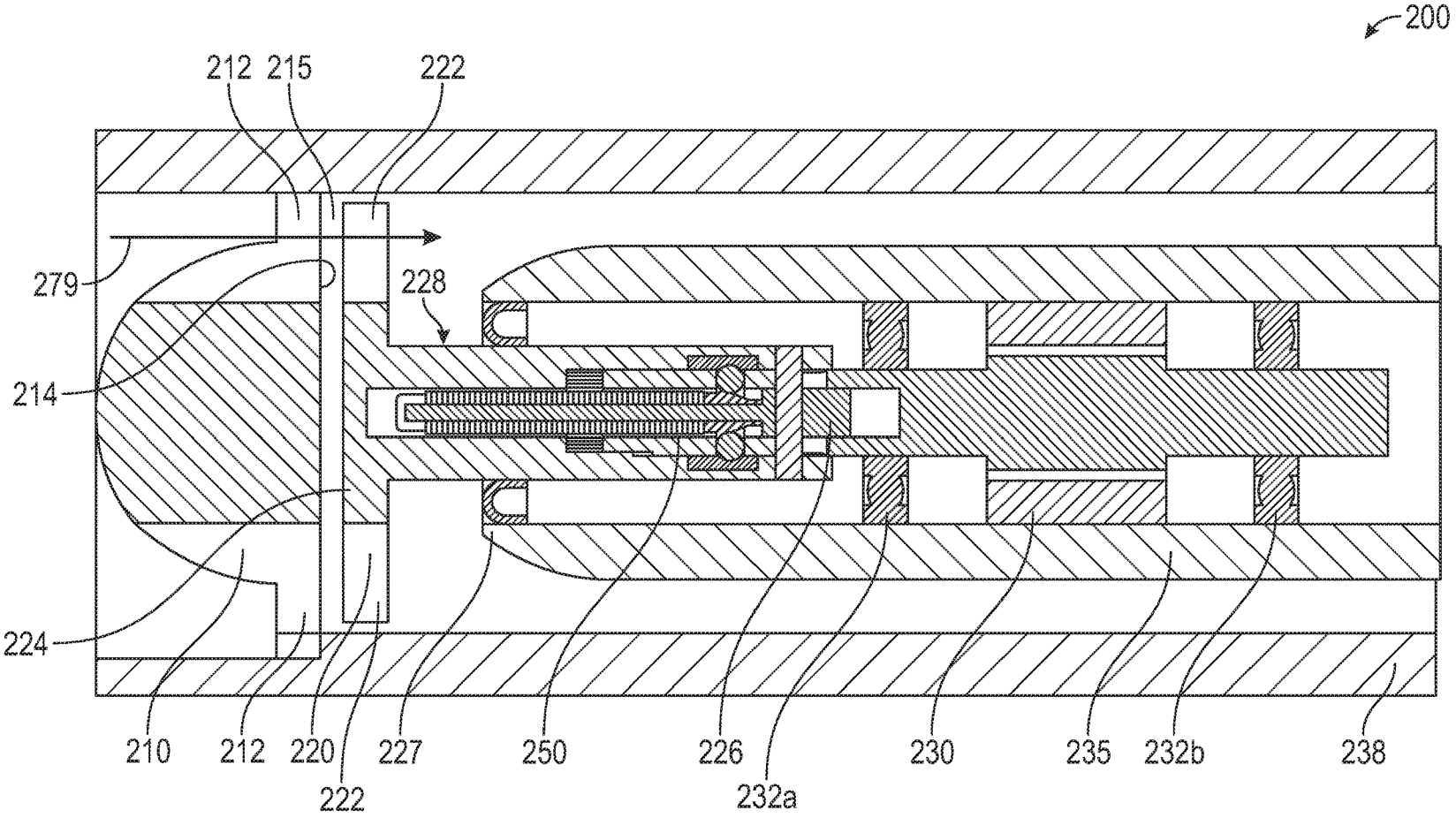
FIG. 2 is a cross-section of a pulser according to one non-limiting embodiment of the disclosure that may be utilized in the drilling assembly shown in FIG. 1.

FIG. 2 is a cross-section of a pulser 200 according to one non-limiting embodiment of the disclosure that may be utilized in a drilling assembly, such as drilling assembly 130 shown in FIG. 1. The pulser 200, in general, includes a channeling element or member that allows the flow of a fluid through the pulser and a restriction element or member, wherein relative movement of such elements obstructs the flow through the channeling element to generate a pressure differential across the pulser and thus a pressure pulse in the fluid. In the pulser 200, the channeling element is shown as stator 210 having one or more fluid flow passages 212 and the restriction element is shown as a rotor 220 having one or more fluid flow passages 222, wherein rotational movement of the rotor relative to the stator obstructs the fluid flow through the stator and thus through pulser 200. In the pulser 200, one side 224 of the rotor 220 and one side 214 of the stator face each other with a gap or space 215 therebetween. The rotor 220 is connected to a drive 230 via a connection member, such as shaft 226. The drive 230 is shown is an electric motor, but it may be any other suitable device, including, but not limited to, a hydraulic device, such as hydraulic motor, a turbine coupled directly to the rotor or a transformer with a gear therebetween. The rotor 220 and the motor 230 are supported by bearings 232*a* and 232*b* in an actuator housing 235. Seals 227 are provided between the actuator housing 235 and an outer spline shaft 228 to prevent fluid flow between the actuator housing 235 and the outer spline shaft 228. The outer spline shaft 228 and an inner spline shaft 226 may be rotationally coupled via any suitable devices, such as splines, keys or equivalent device that allows a relative axial movement, but no relative radial movement. The motor 230 may be configured to oscillate, thereby oscillating the rotor 220 or continuously rotate in either the clockwise or anticlockwise direction, thereby continuously rotating the rotor 220 in direction of the motor 230. The stator 210, rotor 220, motor 230 and the actuator housing 235 are placed inside an outer housing 238. The term rotate or rotation used herein means to include phrases or terms complete rotation and oscillate or oscillation in operation, a drilling fluid 279 flows under pressure through the stator flow passages 212 and the rotor flow passages 222. When the rotor 220 is rotated or oscillated, the rotor passages 222 move away from the stator rotor passages 212 varying the open cross section of the flow path of the fluid 279 through the stator passages 212, obstructing the flow of the fluid 279 through the stator passages 212. Each such obstruction increases pressure across the rotor and thus the pulser which generates a pressure pulse in the fluid 279. The pressure across the rotor or the pulser is also referred herein as the differential pressure. The signals from downhole are sent to the surface as sets of coded pressure pulses. The pressure across the valve section of the pulser (across the rotor in the embodiment of FIG. 2, which is also referred to herein as the "differential pressure") increases from a base pressure to a selected value with each obstruction. The frequency and the amplitude of such pulses is a function of the rotation speed of the rotor and the disturbances created by the shift of the corresponding openings 212 and 222. The gap 215 is typically relatively small and debris in the drilling fluid 279 can clog or jam the rotor and cause the differential pressure to increase to values above the selected differential pressure value or threshold. To avoid or counteract the clogging or jamming of the gap 215, the pulser 200 further includes an activation device 250 that adjusts (increases or decreases) the gap 215 in response to changes in the pressure across rotor. In aspects, the gap 215 increases when the pressure differential is greater than or above a first threshold and decreases when the differential pressure is less than or below a second threshold that is less than the first threshold. The operation of the activation device 250 is described in more detail in references to FIGS. 3-7.

Figure 3:
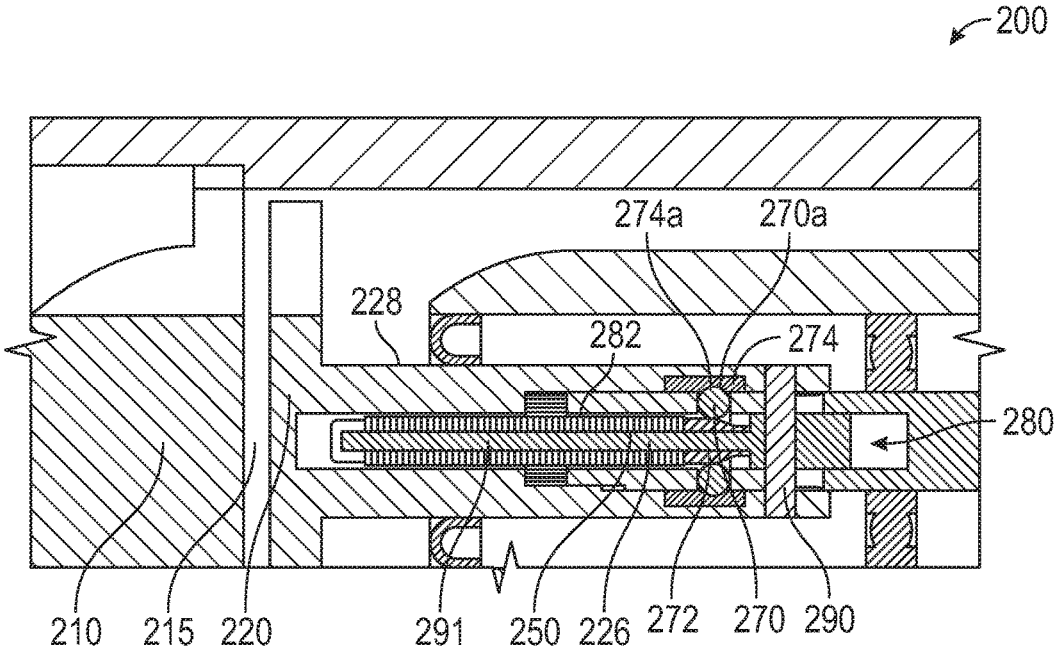
FIG. 3 is a cross-section of the pulser of FIG. 2 when the rotor of the pulser is in its initial or idle state.

FIG. 3 is a cross-section of the pulser 200 of FIG. 2 that shows the gap 215 in its normal or initial state or position 215*a*, i.e., when the differential pressure across the rotor 220 is at or below a selected threshold or value. The activation device 250 includes a roller 270 disposed or trapped between an inner race 272 and an outer race 274. The roller 270 is supported in the axial direction by a support member or inner spline shaft 226. The activation device 250 further includes a force application device, such as the spring assembly 280, in which a spring 282 acts on the outer spline shaft 228 through a pin 290 and a spring shaft 291. The outer race 274 is attached to the outer spline shaft 228 and includes an inner profile 274*a* that acts on the outer profile 270*a* of the roller 270. The roller 270 can move radially, i.e., up and down, but not axially, due to the axial support of the inner spline shaft 226. When the force or pressure on the rotor 220 increases above a selected threshold or a selected value, the rotor 220 starts to move away from the stator 210, causing the outer race 274 to move a certain distance over the ball 270 away (to the right in FIG. 3) from the stator 210, as shown in FIG. 4.

Figure 4:
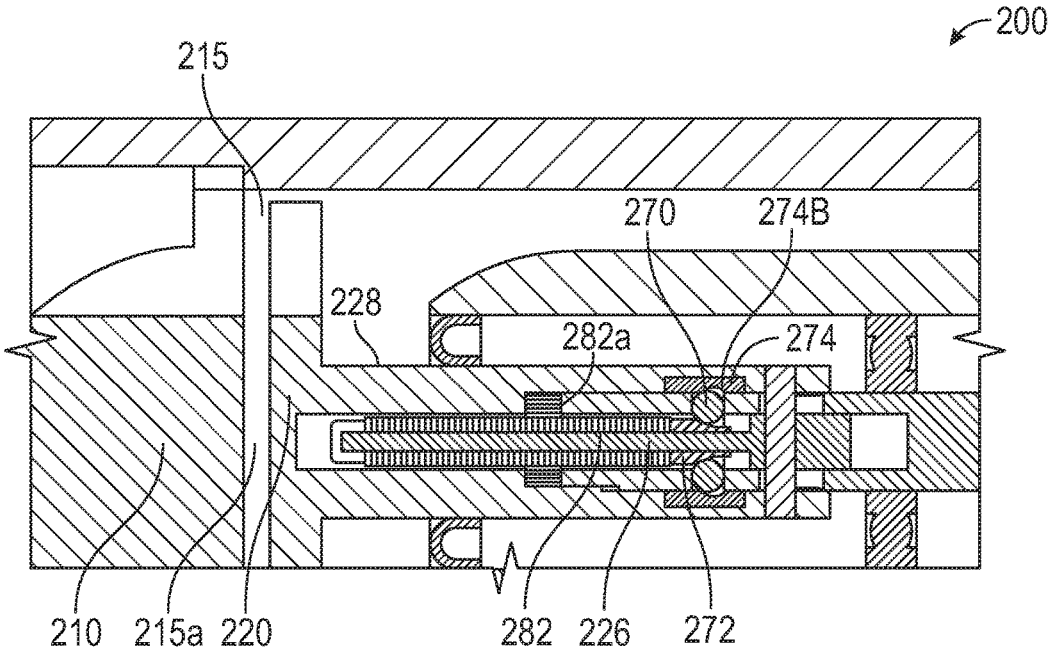
FIG. 4 is the cross-section of the pulser of FIG. 2 when an activation device in the pulser has caused the rotor to partially move away from the stator to increase the gap between the rotor and the stator in response to increase in pressure across the rotor is above a threshold.

FIG. 4 is the cross section of the pulser 200 shown in FIG. 3 when the outer race 274 has moved a portion of its full travel distance or displacement from its initial or normal position shown in FIG. 3, causing the gap 215 to increase to gap 215*b* by an amount less than its full gap position (described later). When the rotor 220 moves to the right, the outer spline 274 moves to the right with the outer spline shaft 228. The movement of the inner profile 274*a* of the outer spline 274 to the right depresses the roller 270 toward the inner race 272, exposing the inner profile 274*a* of the outer spline 274 as shown by gap 274*b*. Movement of the outer spline shaft 228 to the right also compresses the spring 282 to the right through the coupling of the pin 290 and the inner spline shaft 226, loading the spring force against the inner spline shaft 226 and the roller 270. The pin 290 is fixed to the outer spline shaft 228 and the spring shaft 291, hence coupling these elements. The inner spline shaft 226 has an opening larger than the size or diameter of the pin 290, allowing relative axial travel between pin 290 and spring shaft 291. The size of the opening 215 defines the end stop of the axial travel of the pin 290, outer spline shaft, and the rotor.

Still referring to FIG. 4, the spring 282 is further compressed by the movement of the inner race 272 upon the spring shaft 291. With the contact angle between roller 270 and inner race 272 as displayed in FIG. 3, inward movement of the roller 270 causes an enlarged movement of inner race 272, defining a momentary transmission ratio with the momentary contact angle.

Figure 5:
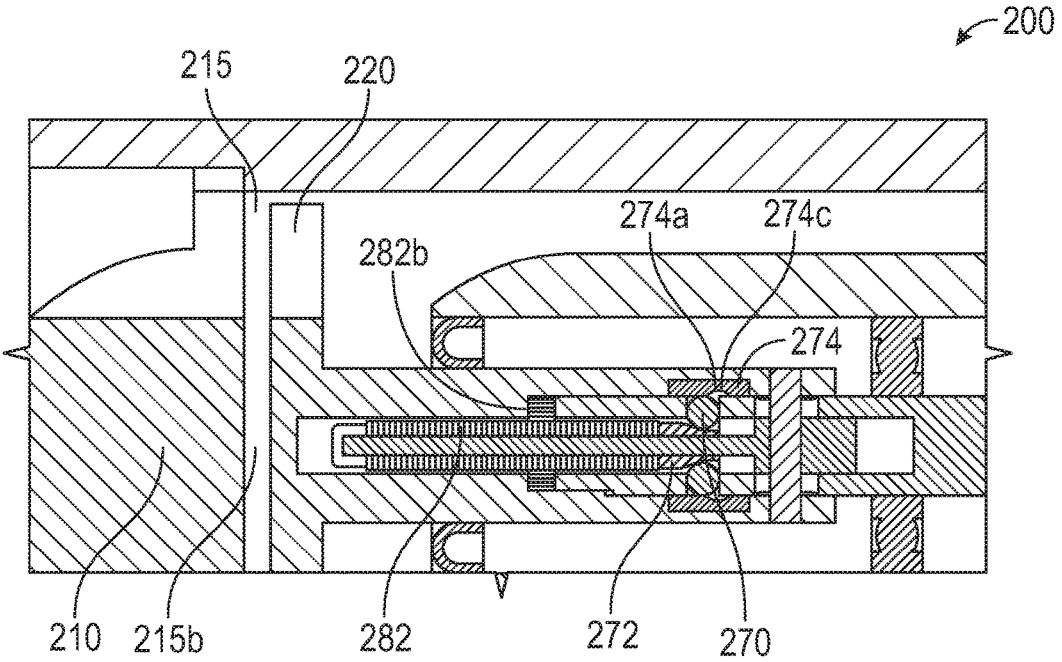
FIG. 5 is the cross-section of the pulser of FIG. 3 when the activation device is at a position prior to enabling the rotor to move away from the stator to provide the maximum gap between the rotor and the stator.

FIG. 5 shows the pulser 200 when the profile 274*a* of the outer race 274 has moved past the roller 270 and no longer restricts further movement of the rotor 220 to the right due to any further increase in the pressure on the rotor 220. In this position, the roller 270 is fully depressed on the inner race 272. The spring 282 further compresses in direct proportional ratio to the restriction device stroke and the gap 215 widens to gap 215*c*. The inner profile 274*a* of the outer race 274 is now fully exposed, as shown by gap 274*c*. The pressure on the roller at this state is referred to as the crack open pressure or force threshold.

Figure 6:
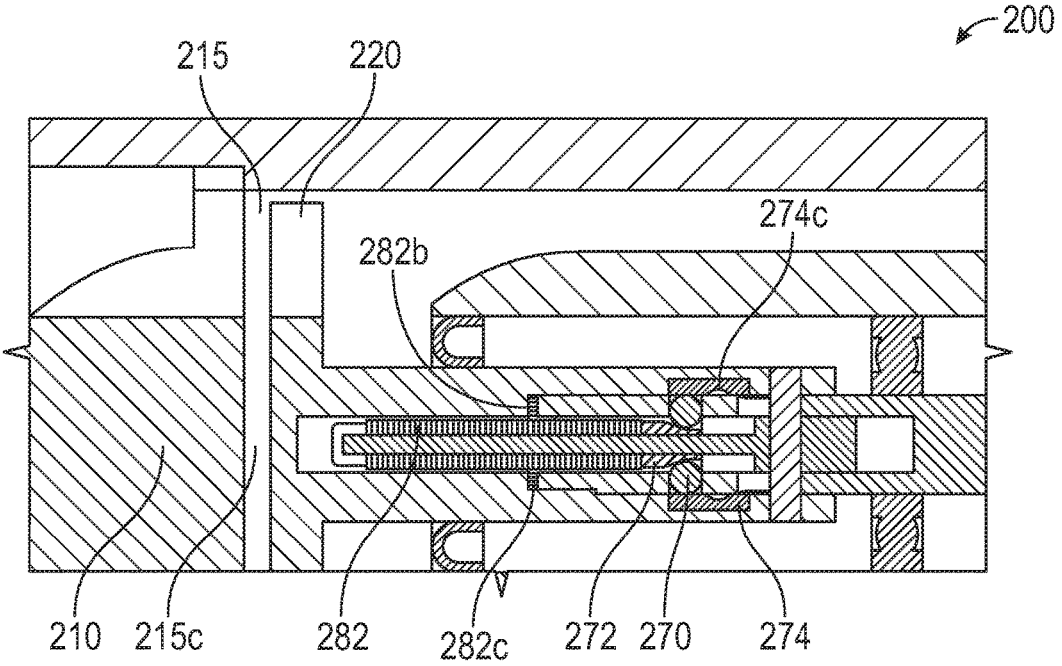
FIG. 6 is the cross-section of the pulser of FIG. 5 when the gap between the rotor and the stator is at its maximum.

FIG. 6 shows the pulser 200 when the outer race 274 has moved to its maximum stroke length due to further marginal increase in the differential pressure across the rotor 220. The differential pressure to cause further opening of the gap 215 is much smaller than the crack open threshold and the increase in the pressure or force required to increase the gap to its final end stop is marginal and solely depends on the spring stack rate or constant. In this position, the gap 215 is at its maximum, as shown by group 215*d*, the spring 282 is fully compressed, and the inner profile 274*a* of the outer race 274 is fully exposed, as shown by gap 274*d*. When the differential pressure across the rotor 220 decreases, and particles obstructing the flow restriction device are flushed away, the spring 282 acting on the spring shaft 291 through the pin 290 onto the outer spline shaft 228, causes the rotor 220 to move toward the stator 210, thereby reducing the gap 215. The gap 215 thus adjusts or alters automatically in response to the differential pressure across the rotor 220. Finally, the rollers lock the mechanism 280 back into position as shown in FIG. 3. The activation device or mechanism 250 is a passive device that adjusts the gap between the rotor 220 and the stator 210 in response to increase in the differential pressure above a threshold or selected value.

Figure 7:
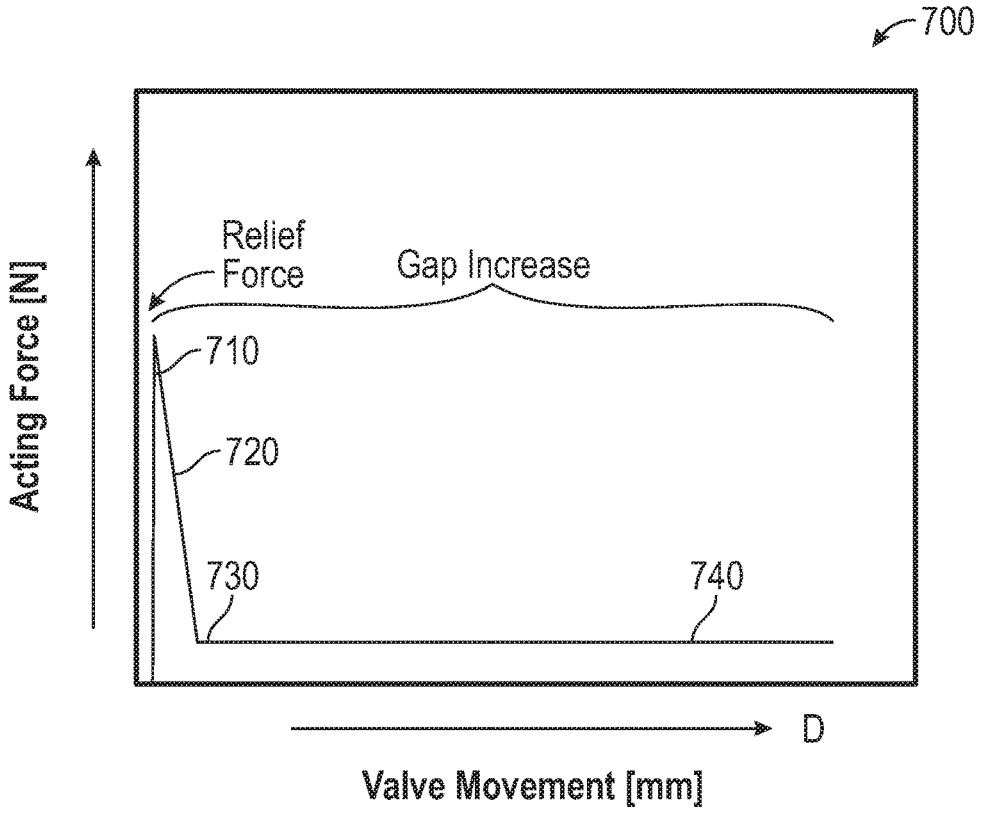
FIG. 7 shows an exemplary relationship between the force acting on the rotor and its displacement or stroke corresponding to displacements or movements of the rotor depicted in FIGS. 3-6.

FIG. 7 shows an exemplary plot 700 of relationship between force "N" acting on the rotor 220 (shown along the y-axis) and the displacement or stroke "D" of the rotor 220 (shown along the x-axis) corresponding to rotor displacements positions shown in FIGS. 3-6. Referring now to FIGS. 3-7, the displacement D is a function of the transition from the stationary friction to the sliding friction of the roller 270 and the outer race 274, roller 270 and inner spline shaft 226, roller 270 and inner race 272 and their respective force contact angles and the resulting friction force. The stroke transmission ratio between rotor stroke and spring compression stroke leads to a significantly higher force than the force exerted alone the spring package 280. For the activation device 250 shown in FIGS. 2-6, before any initial movement of the rotor 220, the sliding friction coefficient defines the relation between the contact force and the movement or displacement of the rotor 220 in a desired direction. With the contact angles and geometries of the activation device 250 shown in FIG. 3, the very steep rise 710 on the acting force at a minimum displacement is caused by the small force contact angle between roller 270 and inner race 272, being just above the self-locking friction angle (~10°-25°), depending on lubrication and material). Once the stationary friction transitions to sliding friction, the force quickly declines, the decline further supported by changes of contact angle between roller 270 and inner spline 272 as shown by decline 720, which corresponds to rotor position shown in FIG. 4. The maximum force (also referred to as the crack open pressure or threshold) is primarily controlled by the immediate transition between stationary friction and sliding friction. The maximum force is reached when the inner race 272 starts to actually move and the stationary friction transitions to sliding friction. At the same time this is the highest transmission ratio between restriction device stroke, roller inward stroke and spring compression stroke (mainly caused by the inner race 272). This position is the transition between FIG. 3 and FIG. 4, visualized in the steep force increase 730 corresponding to rotor position of FIG. 5. The full stroke or displacement 740 corresponds to the rotor position shown in FIG. 6.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a flow restriction device that includes:

a stator having a fluid flow passage;

a rotor spaced from the stator by a gap, wherein relative movement between the rotor and the stator obstructs flow of a fluid flowing through the flow passage to increase pressure in the fluid; and an activation device that displaces one of the stator and the rotor to adjust the gap in response to a change in pressure across a section of the flow restriction device, wherein the activation device provides a first resistance over a first distance through which the rotor moves to adjust the gap, followed by a second resistance over a second distance, wherein the first resistance is greater than the second resistance.

2. The apparatus of claim 1, wherein the activation device increases the gap when the pressure across the section of the restriction device increases above a first threshold and decreases the gap when the pressure across the section of the restriction device decreases below a second threshold that is less than the first threshold.

3. The apparatus of claim 2, wherein the activation device further comprises a spring mechanism that compresses when the pressure across the section of the restriction device is above the first threshold and retracts when the pressure is below the second threshold.

4. The apparatus of claim 1, wherein the restriction device is selected from a group consisting of: a rotary pulser; an oscillating pulser, a bypass valve, a booster valve, a packer valve, and a sampling valve.

5. The apparatus of claim 1, wherein the relative movement is one of: a linear movement; and a rotary movement.

6. The apparatus of claim 1, wherein the activation device further comprises a transmission device that provides resistance to the displacement between the stator and the rotor.

7. The apparatus of claim 6, wherein the transmission device includes a transmission element between a first race and a second race, wherein a profile of the first race and the second race defines a resistance profile for axial displacement between the stator and the rotor.

8. The apparatus of claim 6, wherein the displacement is according to a predefined displacement curve.

9. The apparatus of claim 8, wherein the predefined displacement curve defines a crack open pressure for movement of one of the stator and the rotor.

10. The apparatus of claim 9, wherein the crack open pressure is a function of stationary friction and sliding friction associated with the transmission device.

11. The apparatus of claim 1 further comprising a drilling assembly that includes the flow restriction device to produce pressure pulses in a fluid flowing through the drilling assembly.

12. The apparatus of claim 1, wherein the activation device further comprises:

a transmission element between a first race and a second race;

a spline shaft connected to the first race that supports the transmission element between the first race and the second race;

a spring that acts on the spline shaft; and wherein when the rotor moves away from the stator in response to change in pressure across the section of the restriction device, the first race moves the transmission element toward the second race, the spring compresses and when such pressure is reduced, the spring causes the rotor to move toward the stator.

13. The apparatus of claim 12, wherein the transmission element includes one of: a roller; and a cylinder.

14. A pulser for generating pressure pulses in a fluid flowing through the pulser, comprising:

a stator having a flow passage;

a rotor having a flow passage spaced from the stator that defines a gap between the rotor and the stator, wherein relative movement of the rotor obstructs flow of a fluid flowing through the stator flow passage to produce pressure pulses in the fluid; and an activation device that adjusts the gap in response to a pressure difference across the rotor, wherein the activation device provides a first resistance over a first distance through which the rotor moves to adjust the gap, followed by a second resistance over a second distance, wherein the first resistance is greater than the second resistance.

15. A method of utilizing a flow restriction device in a wellbore, the method comprising:

conveying an assembly in the wellbore that includes a flow restriction device that includes a stator having a flow passage and a rotor spaced from the stator by a gap, wherein relative movement between the rotor and the stator obstructs flow of a fluid flowing through the flow passage to increase pressure in the fluid, and an activation device for displacement of one of the stator and the rotor in response to a change in pressure across a section of the flow restriction device to adjust the gap;

flowing a fluid through the assembly and the flow restriction device; and operating the flow restriction device to obstruct flow of the fluid through the flow restriction device to generate pressure pulses in the fluid flowing through the assembly, wherein the restriction device increases the gap when the pressure across the section is greater than a first threshold and decreases the gap when the pressure across the section is less than a second threshold that is less than the first threshold; and displacing one of the stator and the rotor to adjust the gap via the activation device that provides a first resistance over a first distance through which the rotor moves to adjust the gap, followed by a second resistance over a second distance, wherein the first resistance is greater than the second resistance.

16. The method of claim 15, wherein the assembly is a drilling assembly, the method further comprising:

transmitting signals in form of the pressure pulses in response to a parameter obtained downhole from measurements of a selected sensor.

17. The method of claim 15, wherein the activation device further comprises a transmission device that provides resistance to the displacement between the stator and the rotor.

18. The method of claim 17, wherein the transmission device includes a transmission element between a first race and a second race, wherein a profile of the first race and the second race defines a resistance profile for axial displacement between the stator and the rotor.

19. The method of claim 15, wherein the displacement is according to a predefined displacement curve that defines a crack open pressure for movement of one of the stator and the rotor.

20. The method of claim 19, wherein the crack open pressure is a function of stationary friction and sliding friction associated with the transmission device.

* * * * *